US009332606B2

(12) United States Patent
Lee

(10) Patent No.: US 9,332,606 B2
(45) Date of Patent: May 3, 2016

(54) LED LIGHTING CONTROL SYSTEM

(71) Applicant: NULSOM INC., Daejeon (KR)

(72) Inventor: Chang-Hoon Lee, Daejeon (KR)

(73) Assignee: NULSOM INC., Daejeon (KR)

( * ) Notice: Subject to any disclaimer, the term of this patent is extended or adjusted under 35 U.S.C. 154(b) by 45 days.

(21) Appl. No.: 14/357,886

(22) PCT Filed: Oct. 9, 2012

(86) PCT No.: PCT/KR2012/008156

§ 371 (c)(1),
(2) Date: May 13, 2014

(87) PCT Pub. No.: WO2014/058082

PCT Pub. Date: Apr. 17, 2014

(65) Prior Publication Data

US 2014/0320022 A1 Oct. 30, 2014

(51) Int. Cl.
*H05B 37/02* (2006.01)
*H05B 33/08* (2006.01)

(52) U.S. Cl.
CPC ..... *H05B 33/0842* (2013.01); *H05B 37/0245* (2013.01)

(58) Field of Classification Search
CPC ..... H05B 33/0815
USPC ..... 323/284; 315/192, 307, 294, 320; 363/17
See application file for complete search history.

(56) References Cited

U.S. PATENT DOCUMENTS

| | | | | |
|---|---|---|---|---|
| 2005/0213352 | A1* | 9/2005 | Lys | 363/17 |
| 2006/0002110 | A1* | 1/2006 | Dowling et al. | 362/252 |
| 2010/0283397 | A1* | 11/2010 | Chen | H05B 33/0827 315/192 |
| 2014/0285115 | A1* | 9/2014 | Menegazzi et al. | 315/307 |

FOREIGN PATENT DOCUMENTS

| | | | |
|---|---|---|---|
| JP | 10-241865 | A | 9/1998 |
| JP | 20-0394747 | Y1 | 9/2005 |
| JP | 2007-5104 | A | 1/2007 |
| JP | 2008-522349 | A | 6/2008 |
| JP | 4396052 | B2 | 10/2009 |
| JP | 10-0944943 | B1 | 3/2010 |

* cited by examiner

*Primary Examiner* — Jimmy Vu
*Assistant Examiner* — Wei Chan
(74) *Attorney, Agent, or Firm* — Paratus Law Group, PLLC

(57) ABSTRACT

A light-emitting diode (LED) lighting control system including: a central control device configured to transmit a lighting control signal, which is based on a unidirectional or bidirectional communication protocol, to a plurality of channels; a converter configured to be connected to one of the channels and determine whether the lighting control signal is based on the unidirectional communication protocol or the bidirectional communication protocol in response to the lighting control signal including channel information of the converter; and a driver configured to be connected to the converter and control the operation of a plurality of LED modules in accordance with a control data signal transmitted by the converter.

14 Claims, 11 Drawing Sheets

LED LIGHTING CONTROL SYSTEM

This application is a National Stage Application of International Application No. PCT/KR2012/008156, filed Oct. 9, 2012, the disclosures of which are incorporated by reference herein in their entirety.

BACKGROUND

1. Field of the Invention

Embodiments relate to a light-emitting diode (LED) control system, and more particularly, to an LED lighting control system capable of controlling not only a lighting module supporting unidirectional communication, but also a lighting module supporting bidirectional communication, notifying a central control device of any fault or failure in the unidirectional communication protocol-based lighting module, and removing any delays in lighting control that may be caused by limited communication lines.

2. Description of the Related Art

The Digital Addressable Lighting Interface (DALI) standard has been used for illumination control systems. The DALI standard enables a digital communication lighting control system capable of meeting various user needs by allocating addresses to various combinations of lighting scenes. Referring to FIG. 1, the DALI standard has evolved from the Digital Multiplex (DMX)-512 standard for unidirectional communication to the DMX-512A or Remote Device Management (RDM) standard for bidirectional communication. Devices used in a lighting control system, such as a central control device or a light-emitting diode (LED) driver may not be compatible with one another if they use different communication protocols.

Lighting control systems can be applied to lightings for a large-scale space, such as lightings on the exterior walls of a building, streetlights, or lighting systems for concerts. The replacement of unidirectional communication protocol-based lighting modules with bidirectional communication protocol-based lighting modules may be highly costly, and thus, a lighting system capable of allowing existing lighting modules to be gradually replaced with new lighting modules is needed.

A lighting module, particularly, a light-emitting diode (LED) lighting module, generally includes a considerable number of LEDs, and may thus make it difficult to detect any faulty LED therefrom. Accordingly, a device capable of automatically detecting any faulty LEDs is needed.

In the meantime, most lighting modules use a serial or daisy-chain communication method. For example, according to the DMX-512 standard, signals are transmitted to a maximum of up to 512 channels. More specifically, a control signal may be transmitted to only one of the 512 channels after the transmission of the signals to all the 512 channels. That is, a predetermined channel to which the control signal is to be transmitted may receive the control signal only after the transmission of the signals to the 511 channels, thereby making it difficult to control a lighting system in real time.

SUMMARY

Embodiments provide a light-emitting diode (LED) lighting control system capable of allowing a central control device to identify the existence of any faulty LED in a unidirectional communication protocol-based lighting module.

Embodiments also provide an LED lighting control system capable of easily measuring a voltage or a current for detecting any faulty LED module.

Embodiments also provide an LED lighting control system capable of controlling a plurality of lighting modules without any delays.

However, embodiments are not restricted to the one set forth herein. The above and other embodiments will become more apparent to one of ordinary skill in the art to which the present invention concept pertains by referencing the detailed description of the embodiments given below.

According to embodiments, an LED lighting control system includes: a central control device configured to transmit a lighting control signal, which includes a control data signal for being used in controlling one or more LED modules and a control instruction signal for controlling the LED modules in accordance with the control data signal, to a plurality of channels, the control instruction signal being based on one of a unidirectional communication protocol and a bidirectional communication protocol; a converter configured to be connected to one of the channels and determine whether the lighting control signal is based on the unidirectional communication protocol or the bidirectional communication protocol in response to the lighting control signal including channel information of the converter; and a driver configured to be connected to the converter and control the operation of a plurality of LED modules in accordance with a control data signal transmitted by the converter, wherein the converter is further configured to determine whether the driver is based on the unidirectional communication protocol or the bidirectional communication protocol and convert the communication protocol of the lighting control signal in response to the communication protocol of the driver being different from the communication protocol of the lighting control signal.

The LED lighting control system can allow lighting modules using different communication protocols to bilaterally communicate with a central control device, and can notify the central control device to identify the existence of any faulty LED modules. Since there is no need to replace existing unidirectional communication protocol-based lighting modules with bidirectional communication protocol-based lighting modules, the maintenance and installation cost for a lighting system can be reduced. In addition, faulty LED modules can be automatically identified, thereby facilitating the maintenance of a lighting system. Moreover, since comparators are used, instead of analog-to-digital converters (ADCs), the structure of a lighting control system can be simplified, and the manufacturing cost of a lighting control system can be reduced. Furthermore, since lighting control data is transmitted first and then lighting modules can be controlled in accordance with the lighting control data, the lighting modules can be controlled in real time.

Other features and aspects will be apparent from the following detailed description, the drawings, and the claims.

DETAILED DESCRIPTION OF THE EMBODIMENTS

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. Also, descriptions of functions and constructions that are well known to one of ordinary skill in the art may be omitted for increased clarity and conciseness.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The terms "module" and "unit" used to signify components are used herein to aid in the understanding of the components and thus they should not be considered as having specific meanings or roles. Accordingly, the terms "module" and "unit" may be used interchangeably.

As used herein the expression "and/or" includes any and all combinations of one or more of the associated listed items.

Figure 1:
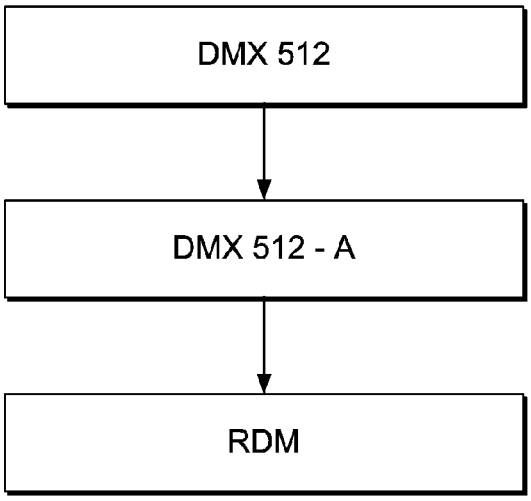
FIG. 1 is a flowchart showing digital lighting control standards.
Figure 2:
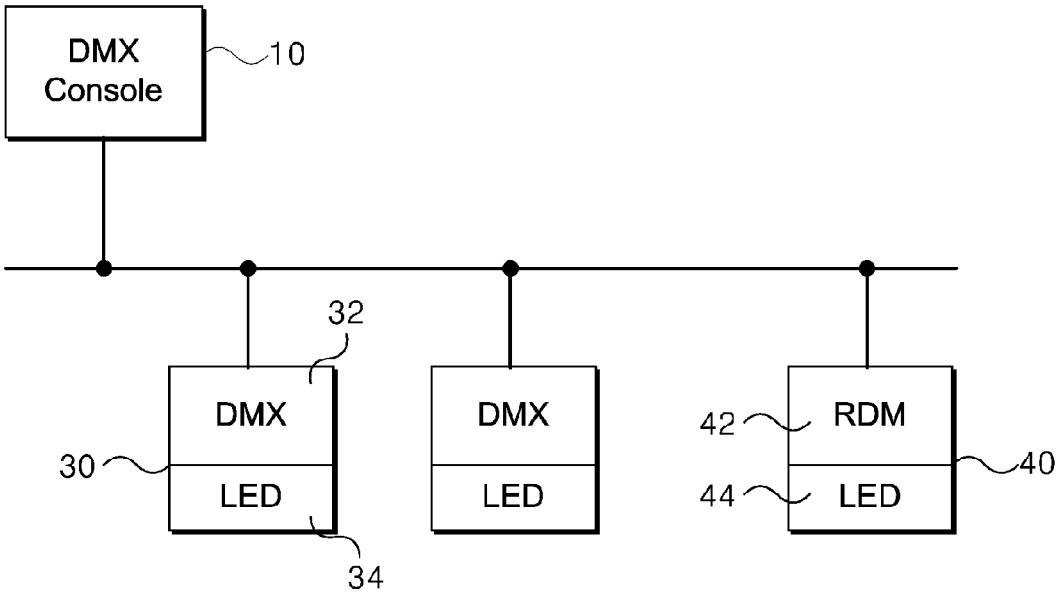
FIGS. 2 to 4 are block diagrams illustrating various lighting control systems to which a unidirectional communication protocol and a bidirectional communication protocol are both applied.
Figure 3:
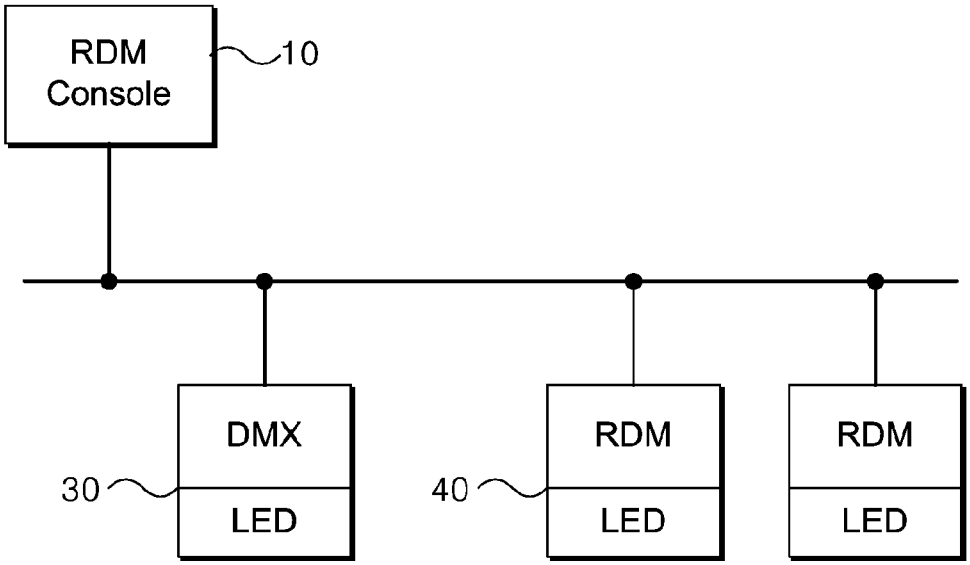
Figure 4:
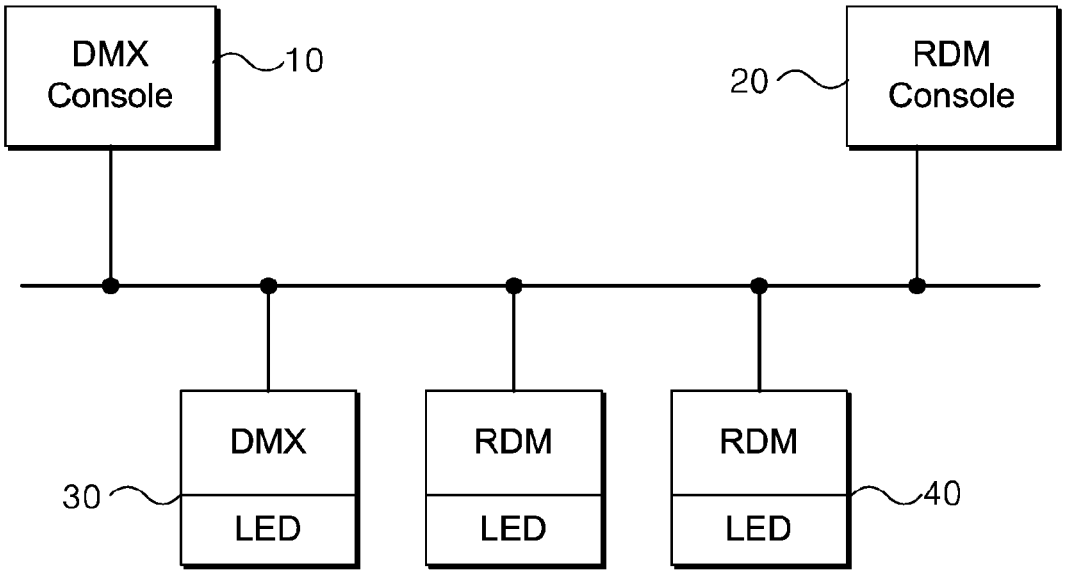

FIGS. 2 to 4 are block diagrams illustrating various examples of a lighting control system to which a unidirectional communication protocol and a bidirectional communication protocol are both applied.

Referring to FIG. 2, a lighting control system may include a Digital Multiplex (DMX) central control device 10, which is based on a unidirectional communication protocol, i.e., the DMX protocol, two DMX lighting modules 30, which are based on the DMX protocol, and a Remote Device Management (RDM) lighting module 40, which is based on a bidirectional communication protocol, i.e., the RDM protocol.

The DMX central control device 10 generally controls the DMX lighting modules 30 and the RDM lighting module 40, which are networked with one another. Each of the DMX lighting modules 30 locally controls an LED module 34 via a driver 32, and the RDM lighting module 40 locally controls an LED module 44 via a driver 42.

The DMX central control device 10 can control the DMX lighting modules 30, which are based on the unidirectional communication protocol, but cannot properly control the RDM lighting module 40, which is not based on the unidirectional communication protocol, but based on the bidirectional communication protocol.

Referring to FIG. 3, a lighting control system may include a RDM central control device 20, which is based on the RDM protocol, a DMX lighting module 30, which is based on the DMX protocol, and two RDM lighting modules 40, which are based on the RDM protocol.

The RDM central control device 20 can control the RDM lighting modules 40, which are based on the bidirectional communication protocol, but cannot properly control the DMX lighting module 30, which is not based on the bidirectional communication protocol, but based on the unidirectional communication protocol.

Referring to FIG. 4, a lighting control system includes a DMX central control device 10, which is based on the DMX protocol, an RDM central control device 20, which is based on the RDM protocol, a DMX lighting module 30, which is based on the DMX protocol, and two RDM lighting modules 40, which are based on the RDM protocol.

The DMX central control device 10 and the RDM central control device 20 cannot transmit a lighting control signal at the same time.

The DMX central control device 10 cannot properly control the RDM lighting modules 40, which are based on the bidirectional communication protocol, and the RDM central control device 20 cannot properly control the DMX lighting module 30, which is based on the unidirectional communication protocol.

Figure 5:
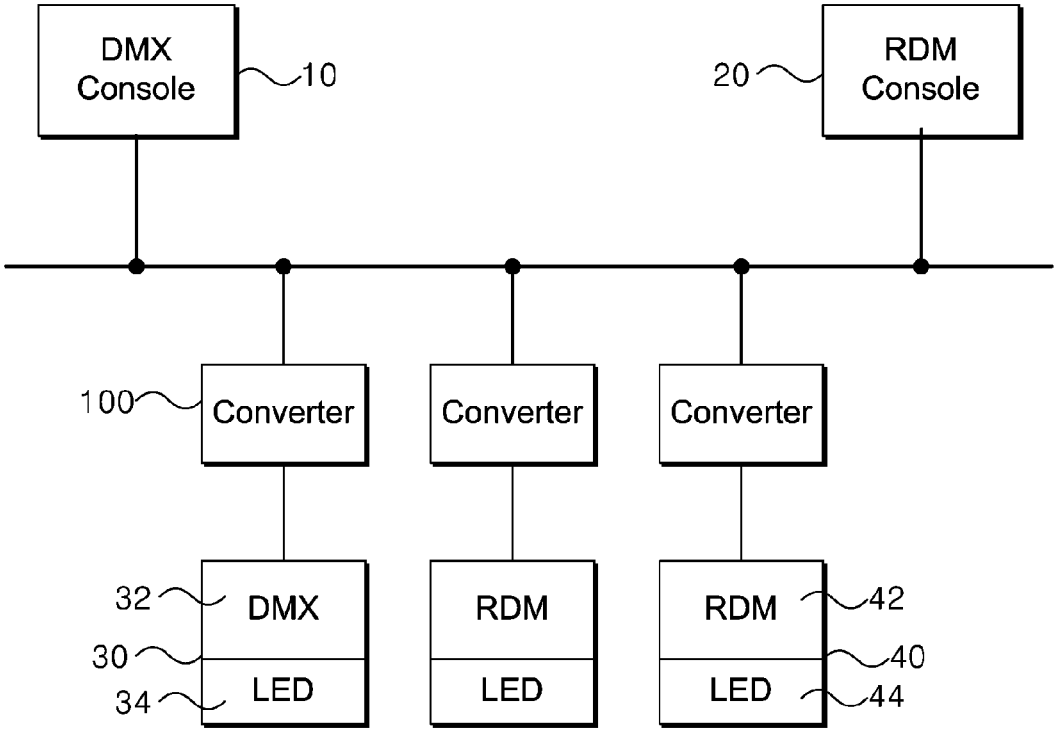
FIG. 5 is a block diagram illustrating a light-emitting diode (LED) lighting control system according to an embodiment.

FIG. 5 is a block diagram illustrating a light-emitting diode (LED) lighting control system according to an embodiment.

Referring to FIG. 5, an LED lighting control system may include a DMX central control device 10, an RDM central control device 20, a DMX lighting module 30, two RDM lighting modules 40, and a plurality of converters 100.

Two or more elements of the LED lighting control system may be incorporated into a single element, or one of the elements of the LED lighting control system may be divided into two or more sub-elements.

The DMX central control device 10 and the RDM central control device 20 transmit a lighting control signal to the DMX lighting module 30 and the RDM lighting modules 40, respectively, via a communication network. The communication network may be a wired network, a wireless network, or a combination thereof. Power Line Communication (PLC) may be used for the wired network, PLC, Bluetooth, Radio Frequency Identification (RFID), Infrared Data Association (IrDA, Ultra Wideband (UWB), ZigBee and other various wireless communication techniques may be used for the wireless network.

Only one of the DMX central control device 10 and the RDM central control device 20 may be driven at one time. The DMX central control device 10 and the RDM central control device 20 may transmit DMX- and RDM-based lighting control signals, respectively, via the communication network. The LED lighting control system is illustrated in FIG. 5 as including both the DMX central control device 10 and the RDM central control device 20, but the present inventive concept is not limited to this. That is, the LED lighting control system may include one or more central control devices that are based on the same type of communication protocol.

Each of the lighting module 30 and the lighting modules 40 may have unique channel information. The DMX central control device 10 may control the lighting module 30 and the lighting modules 40 individually based on the channel information of the lighting module 30 and the lighting modules 40.

The DMX lighting module 30 may include a DMX driver 32, which is based on the DMX protocol, and an LED module 34. The DMX driver 32 may control the luminous intensity of the LED module 34 based on a DMX-based lighting control signal. The DMX driver 32 may receive a lighting control signal from the DMX central control device 10 or the RDM central control device 20, but may not be able to transmit information to the DMX central control device 10 and the RDM central control device 20.

Each of the RDM lighting modules 40 may include an RDM driver 42, which is based on the RDM protocol, and an LED module 44. The RDM driver 42 may control the luminous intensity of the LED module based on an RDM-based lighting control signal.

Each of the converters 100 may interpret a lighting control signal transmitted by the DMX central control device 10 or the RDM central control device 20, may convert the lighting control signal to a protocol suitable for a driver 30 or 40 connected thereto, and may transmit the converted lighting control signal to the driver 30 or 40.

Figure 6:
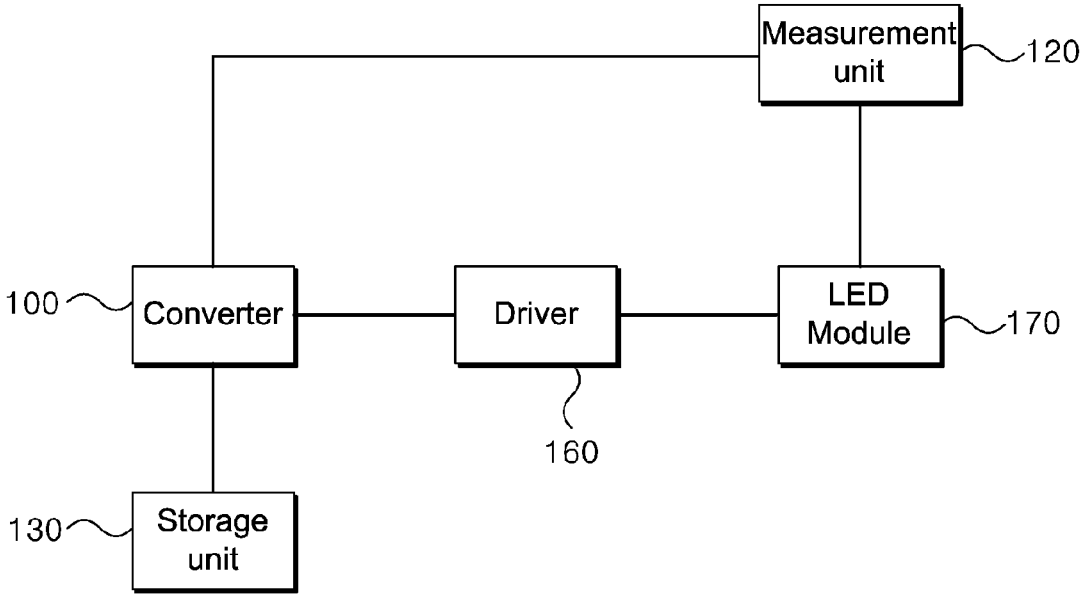
FIG. 6 is a block diagram illustrating a client corresponding to a channel of the LED lighting control system of FIG. 5.

FIG. 6 is a block diagram illustrating a client corresponding to a channel of the LED lighting control system of FIG. 5.

Referring to FIG. 6, a client may include a converter 100, a measurement unit 120, a storage unit 130, a driver 160 and an LED module 170. The measurement unit 120 or the storage unit 130 may be incorporated into the converter 100.

The LED module 170 may include a plurality of LEDs groups connected in parallel. Each of the LED groups may include a single LED or one or more LEDs connected in series. Each of the LED groups may have identification information. Each of the LED groups may include one or more LEDs that emit light of the same color. An LED group including a single LED and an LED group including two or more LEDs connected in series may constitute separate channels.

The driver 160 may adopt one of the DMX protocol and the RDM protocol, and may interpret a lighting control signal that is based on either the DMX protocol or the RDM protocol. The driver 160 may control the supply of power to the LED module 170 in accordance with the lighting control signal. The driver 160 may control the LED groups independently based on the identification information of the LED groups. The driver 160 may apply a predetermined voltage to the LED groups, and may control LED light emitted from the LED module 170 with a current. To control the luminous intensity of the LED module 170, Pulse Width Modulation (PWM) may be used.

The storage unit 130 may store programs for processing and controlling the converter 100, and may also store any lighting control signal received by the converter 100.

The measurement unit 120 may compare a voltage or current applied to the LED module 170 with a reference level, and may output the results of the comparison as digital data.

The converter 100 may determine the type of communication protocol used by the driver 160. For example, the converter 100 may transmit an acknowledgement request signal to the driver 160, and may determine that the communication protocol used by the driver 160 as being the RDM protocol in response to receipt of an acknowledgement signal from the driver 160.

The converter 100 may determine the communication protocol of a lighting control signal received via a communication network. In response to the communication protocol of the received lighting control signal being different from the communication protocol of the driver 160, the converter 100 may convert the received lighting control signal to the communication protocol of the driver 160. The converter 100 may provide the lighting control signal to the driver 160 according to a predefined set of conditions.

Figure 7:
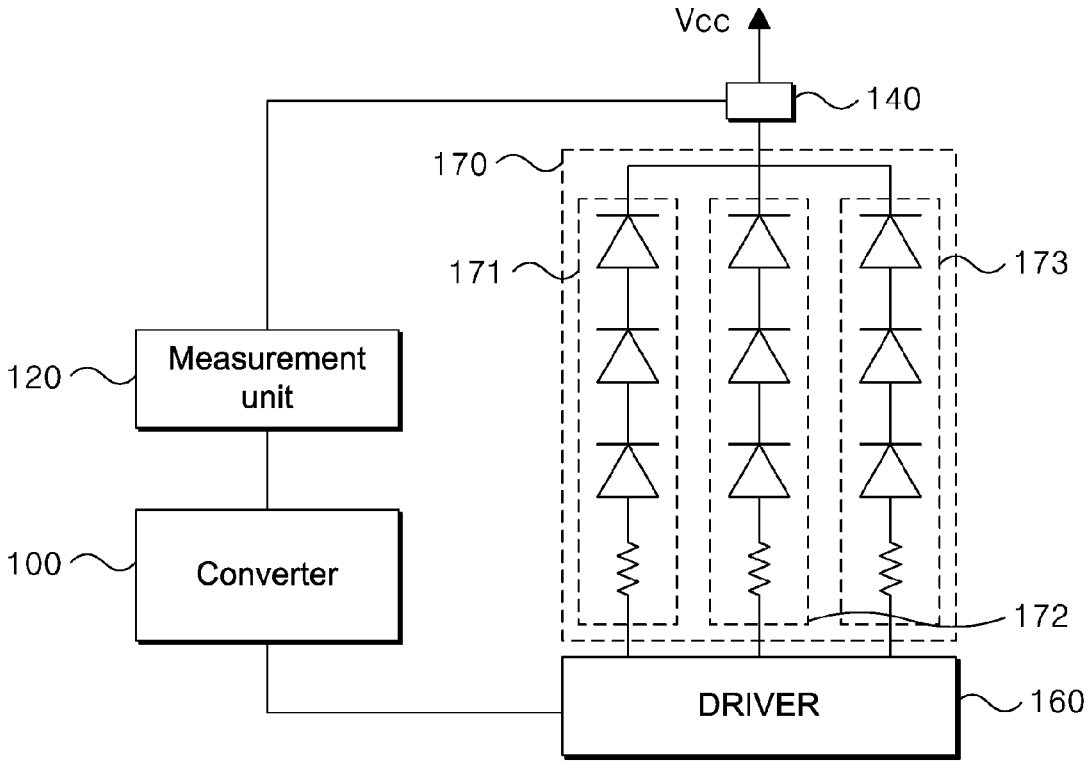
FIGS. 7 and 8 are circuit diagrams illustrating an example of a measurement unit of FIG. 6.
Figure 8:
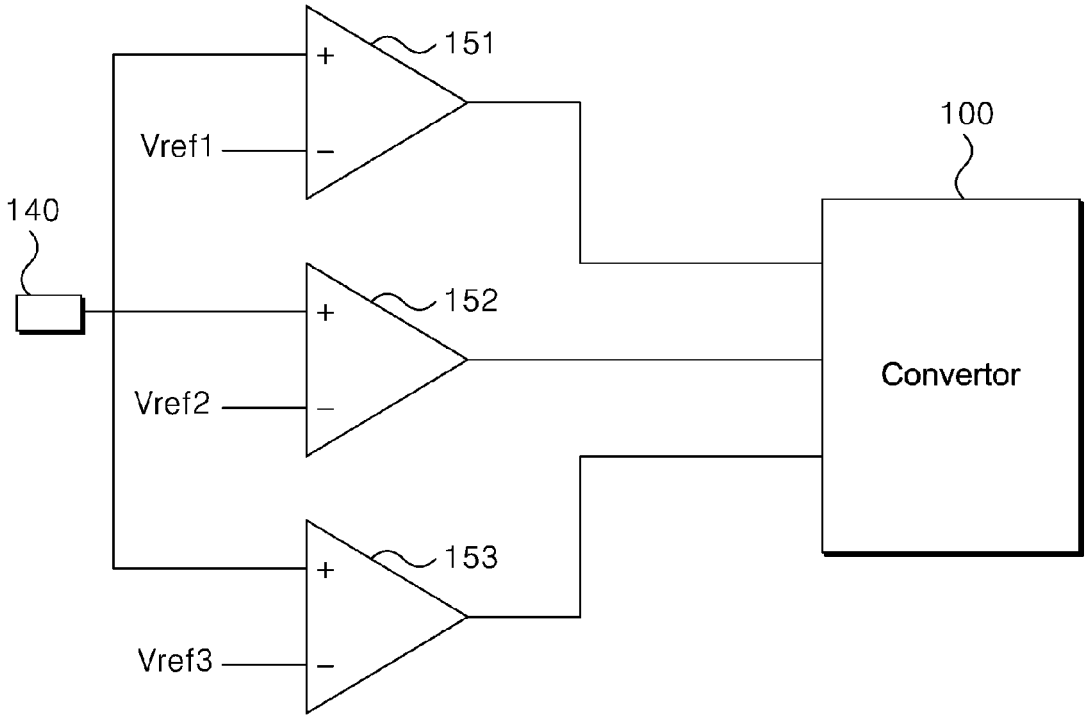
Figure 9:
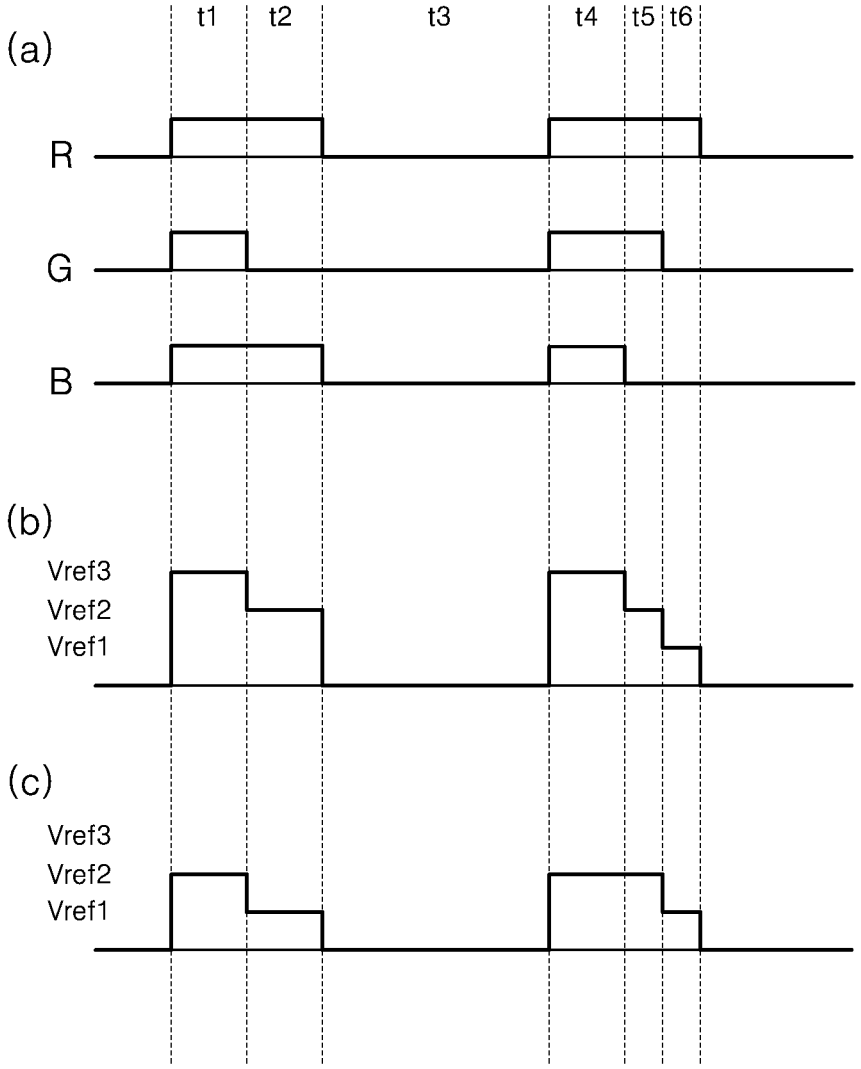
FIG. 9 is a signal diagram illustrating control data and the output of the measurement unit.

FIGS. 7 and 8 are circuit diagrams illustrating an example of the measurement unit 120, and FIG. 9 is a signal diagram illustrating control data and the output of the measurement unit 120.

Referring to FIGS. 6 to 8, the measurement unit 120 may include a circuit power measurement module 140 and a plurality of first, second and third comparators 151, 152 and 153.

The circuit power measurement module 140 may measure the total voltage or current applied to the LED module 170. The driver 160 may control power to be supplied to the LED module 170 through switching control, and a typical transistor or a metal oxide semiconductor (MOS) transistor may be used as a switch for such switching control. In response to the circuit power measurement module 140 being connected to a power terminal Vcc, the circuit power measurement module 140 may generate an output that is proportional to the current applied to the LED module 170. The output that is proportional to the current applied to the LED module 170 may be a voltage in consideration that there are many comparators using a voltage.

A converted voltage provided by the converter 100 may be input to the first, second and third comparators 151, 152 and 153. The first, second and third comparators 151, 152 and 153 may compare with the converted voltage with first, second and third reference voltages Vref1, Vref2 and Vref3, respectively, and may output the results of the comparison as digital values. The digital values may be transmitted to the converter 100. The first reference voltage Vref1 may be a voltage obtained by connecting one of first, second and third LED groups 171, 172 and 173 to a power source, the second reference voltage Vref2 may be a voltage obtained by connecting two of the first, second and third LED groups 171, 172 and 173 to the power source, and the third reference voltage Vref3 may be a voltage obtained by connecting all the first, second and third LED groups 171, 172 and 173 to the power source.

The digital values output by the first, second and third comparators 151, 152 and 153 may correspond to the first, second and third LED groups 171, 172 and 173, respectively. The converter 100 may identify the number of LED groups that actually need to be driven based on control data for controlling the luminous intensity of the LED module 170. The control data may be included in a lighting control signal. The converter 100 may compare the number of LED groups that actually need to be driven with the number of LED groups currently being driven based on the digital values output by the first, second and third comparators 151, 152 and 153, and may determine whether the LED module 170 is properly being driven. In response to the number of LED groups that actually need to be driven not matching the number of LED groups currently being driven, the converter 100 may detect the abnormality of that the LED module 170, and may detect one or more LED groups that are supposed to be driven, but not actually being driven, through comparison. For example, the converter 100 may generate a list of LED group candidates that appear to operate abnormally, and may eliminate one or more LED groups that are actually being driven properly from the generated list.

The determination of the abnormality of the LED module 170 will hereinafter be described in further detail with reference to FIG. 9. FIG. 9(*a*) is a signal diagram of three control data signals applied to R, G and B channels, respectively, wherein each of the R, G and B channels may be an LED group including one or more LEDs connected in series. FIG. 9(*b*) is a signal diagram of a combined control data signal obtained by combining the three control data signals. FIG. 9(*c*) is a signal diagram illustrating a combined output signal obtained by combining the data values output by the first, second and third comparators 151, 152 and 153. The comparator 100 may compare the signal diagram of the combined control signal diagram with the signal diagram of the combined output signal, and may detect periods of time t1, t2 and t4 during which the LED module 170 appear to have operated abnormally. More specifically, the converter 100 may compare the level of the combined control data signal during each of the time periods t1 and t2 with the level of the combined output signal during each of the time periods t1 and t2, and may thus detect any fault in the R or B channel. Similarly, the converter 100 may compare the level of the combined control data signal during the time period t3 with the level of the combined output signal during the time period t3, and may thus detect any fault in the B channel.

In response to the LED module 170 being detected to operate abnormally, the converter 100 may transmit a fault notification signal to the DMX central control device 10 or the RDM central control device 20. The fault notification signal may include faulty channel information and faulty LED group identification information.

The converter 100 may perform fault diagnosis on the LED module 170 either intermittently or in response to receipt of a fault diagnosis instruction from the DMX central control device 10 or the RDM central control device 20, thereby preventing waste of resources.

The converter 100 may determine the abnormality of the LED module 170 based on control data for controlling the luminous intensity of the LED module 170, which is either generated by the converter 100 or received from the central control device 10 or the RDM central control device 20 for "fault diagnosis" purposes. For example, the control data for fault diagnosis may set the first, second and third LED groups 171, 172 and 173 to emit light at different times. In this example, the converter 100 may properly perform fault diagnosis on the LED module 170 by using a single comparator, rather than a plurality of comparators.

Figure 10:
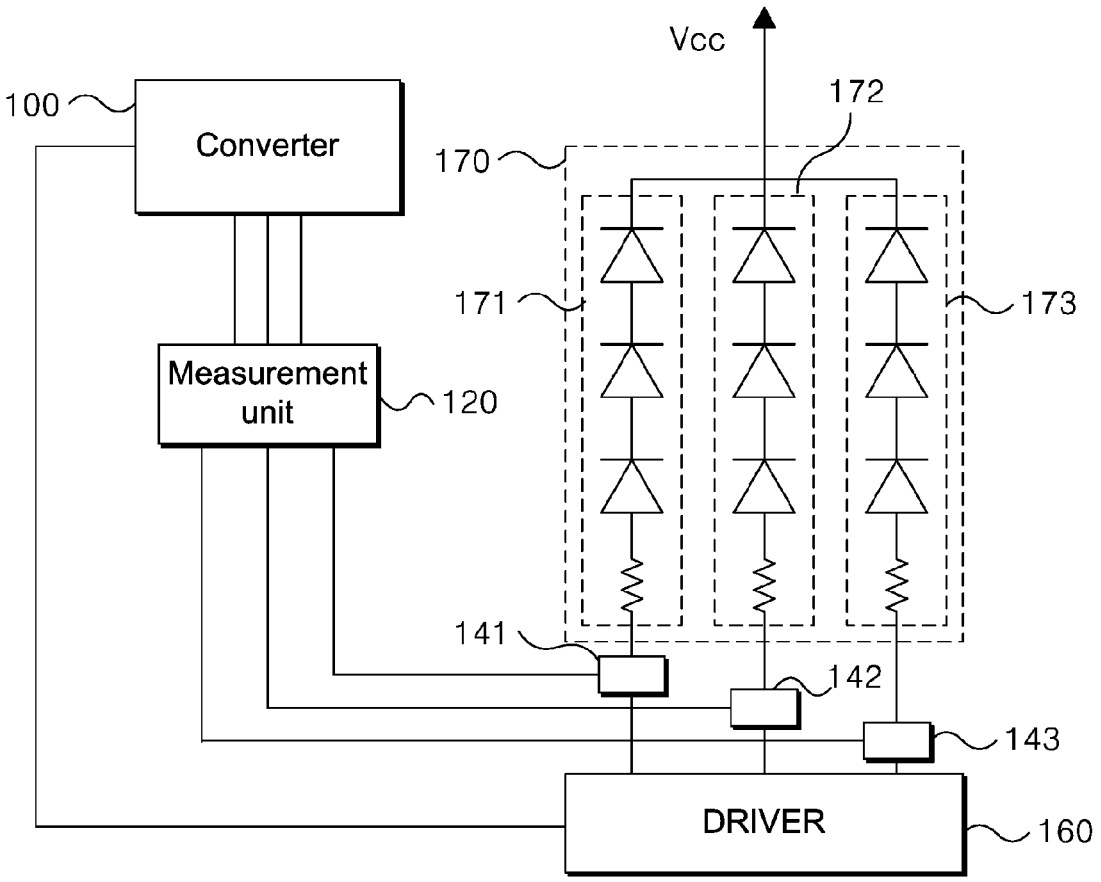
FIGS. 10 and 11 are circuit diagrams illustrating another example of the measurement unit.
Figure 11:
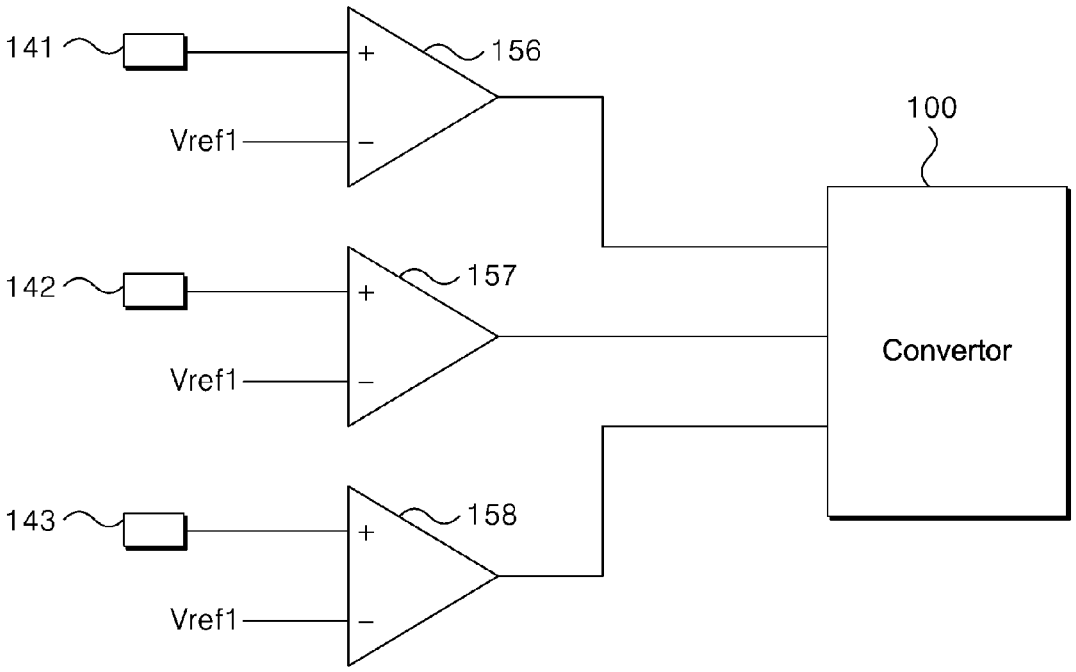

FIGS. 10 and 11 are circuit diagrams of another example of the measurement unit 120.

Referring to FIGS. 6, 10 and 11, the measurement unit 120 may include a plurality of first, second and third circuit power measurement modules 141, 142 and 143 and a plurality of fourth, fifth and sixth comparators 156, 157 and 158.

The first, second and third circuit power measurement modules 141, 142 and 143 may generate voltages corresponding to the currents applied to the first, second and third LED groups 171, 172 and 173, respectively. The generated voltages may be input to the fourth, fifth and sixth comparators 156, 157 and 158, respectively. The fourth, fifth and sixth comparators 156, 157 and 158 may compare the generated voltages with a reference voltage Vref1, which is a voltage for driving a single LED group, and may output the results of the comparison as digital values. The converter 100 may determine the abnormality of the LED module 170 based on the digital values output by the fourth, fifth and sixth comparators 156, 157 and 158. For example, the converter 100 may compare the digital values output by the fourth, fifth and sixth comparators 156, 157 and 158 with control data, which is provided to the driver 160, and may detect one or more LED groups yet to be matched. In response to the LED module 170 being determined to operate abnormally, the converter 100 may transmit a fault notification signal, including faulty LED group identification information and faulty channel information, to the DMX central control device 10 or the RMD central control device 20.

The first, second and third circuit power measurement modules 141, 142 and 143 and the fourth, fifth and sixth comparators 156, 157 and 158 may all be incorporated into the driver 160.

Figure 12:
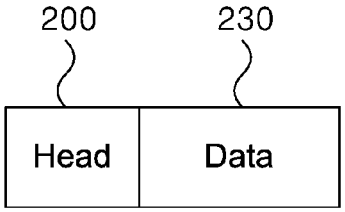
FIG. 12 is a diagram illustrating the packet format of a lighting control signal packet according to an embodiment.

FIG. 12 is a diagram illustrating the packet format of a lighting control signal according to an embodiment.

Referring to FIG. 12, a lighting control signal may include a header 200 and a data field 230.

The header 200 may include a beginning code indicating the beginning of the lighting control signal, an end code indicating the end of the lighting control signal, channel number information and channel group number information, and a code indicating whether the lighting control signal is a control data signal or a control instruction signal.

A channel group is a group of channels and may have a channel group number. The converter 100 may determine whether the lighting control signal is destined for the converter 100 by determining whether the same channel number as the channel number of the converter 100 is included in the header 200 or a channel group number including the channel number of the converter 100 is included in the header 200.

Examples of the lighting control signal may include a control data signal and a control instruction signal. The control data signal may include control data for adjusting the color or the luminous intensity of the LED module 170, and the control instruction signal may include an instruction code for allowing the converter 100 or the driver 160 to execute a predetermined instruction.

The data field 230 may include a control data code, including the actual content of a control data signal, a time stamp or a program number code relating to the control data code, an instruction code of a control instruction signal, a program number list code relating to the instruction code, and a dummy code.

In response to the header 200 including the beginning code or end code, the data field 230 may include the dummy code.

The control data code may include the luminous intensity of each LED module.

A time stamp is a time indicator. In response to a time stamp being included in the lighting control signal, the converter 100 may transmit a control data code corresponding to the time stamp to the driver 160.

The instruction code may include a synchronization instruction for allowing the driver 160 to control the LED module 170 in accordance with most recently-received control data. For this, the converter 100 may transmit control data most recently stored in the storage unit 130 to the driver 160. The instruction code may also include a fault diagnosis instruction for controlling the converter 100 to detect the abnormality of the LED module 170.

The program number code may indicate identification information of control data. The program number list code, which is a set of program numbers, may include at least one program number code.

Figure 13:
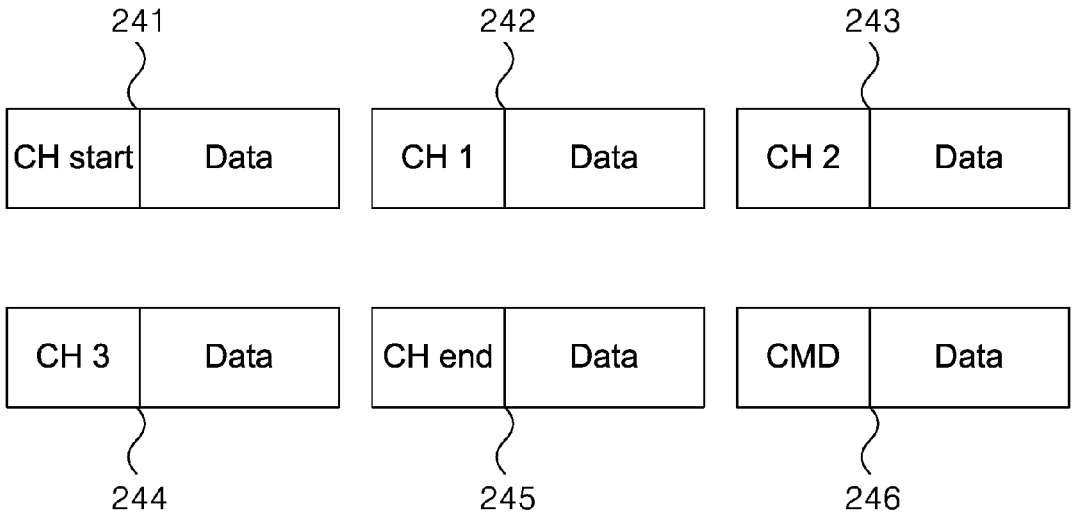
FIG. 13 is a diagram illustrating lighting control signal packets according to an embodiment.

FIG. 13 is a diagram illustrating lighting control signal packets according to an embodiment.

The DMX central control device 10 or the RDM central control device 20 may transmit a lighting control signal having the packet format illustrated in FIG. 12 to each channel.

Referring to FIG. 13, a packet 241 may include a beginning code indicating that control data is to be transmitted. The data field of the packet 241 may include a dummy signal. Packets 242, 243 and 244 may include control data. Each of the headers of the packets 242, 243 and 244 may include a channel number of a channel group number. A channel group is a group of channels and may have a channel group number. A packet 245 may include an end code indicating that no more control data is to be transmitted. A packet 246 may include a control instruction signal.

Figure 14:
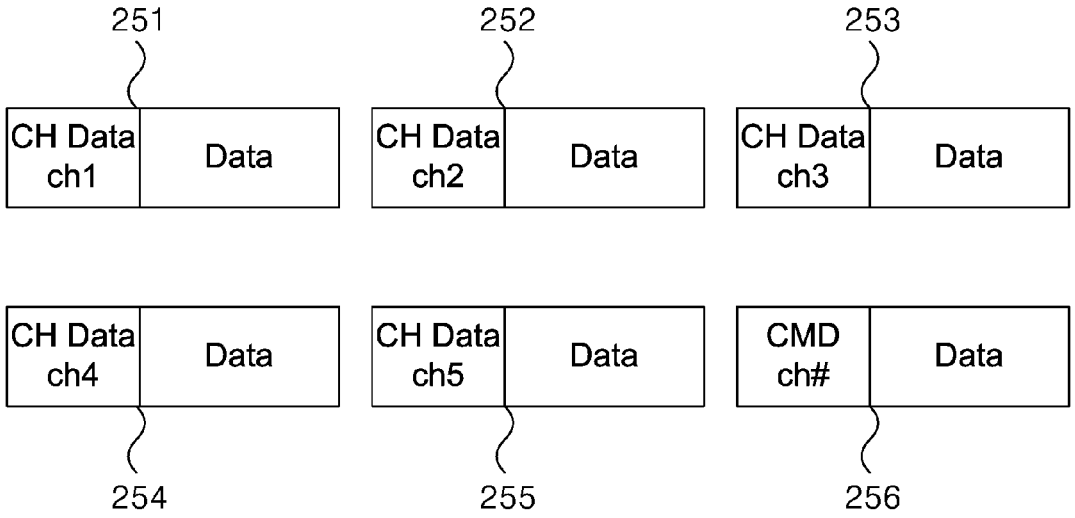
FIG. 14 is a diagram illustrating lighting control signal packets according to another embodiment.

FIG. 14 is a diagram illustrating lighting control signal packets according to another embodiment.

The DMX central control device 10 or the RDM central control device 20 may transmit a lighting control signal having the packet format illustrated in FIG. 12 to each channel.

Referring to FIG. 13, each of a plurality of packets 251 to 255 may include a header indicating that a corresponding packet is a control data packet and a data field including the content of the control data packet. A packet 256 may include a header indicating that the packet 256 is a control instruction signal packet and a data field including the content of the control instruction signal packet. Each of the headers of the packets 251 to 256 may include channel information.

In the embodiment of FIG. 13, unlike in the embodiment of FIG. 12, a beginning code or an end code is unnecessary, and a control data signal and a control instruction signal can be transmitted randomly.

Figure 15:
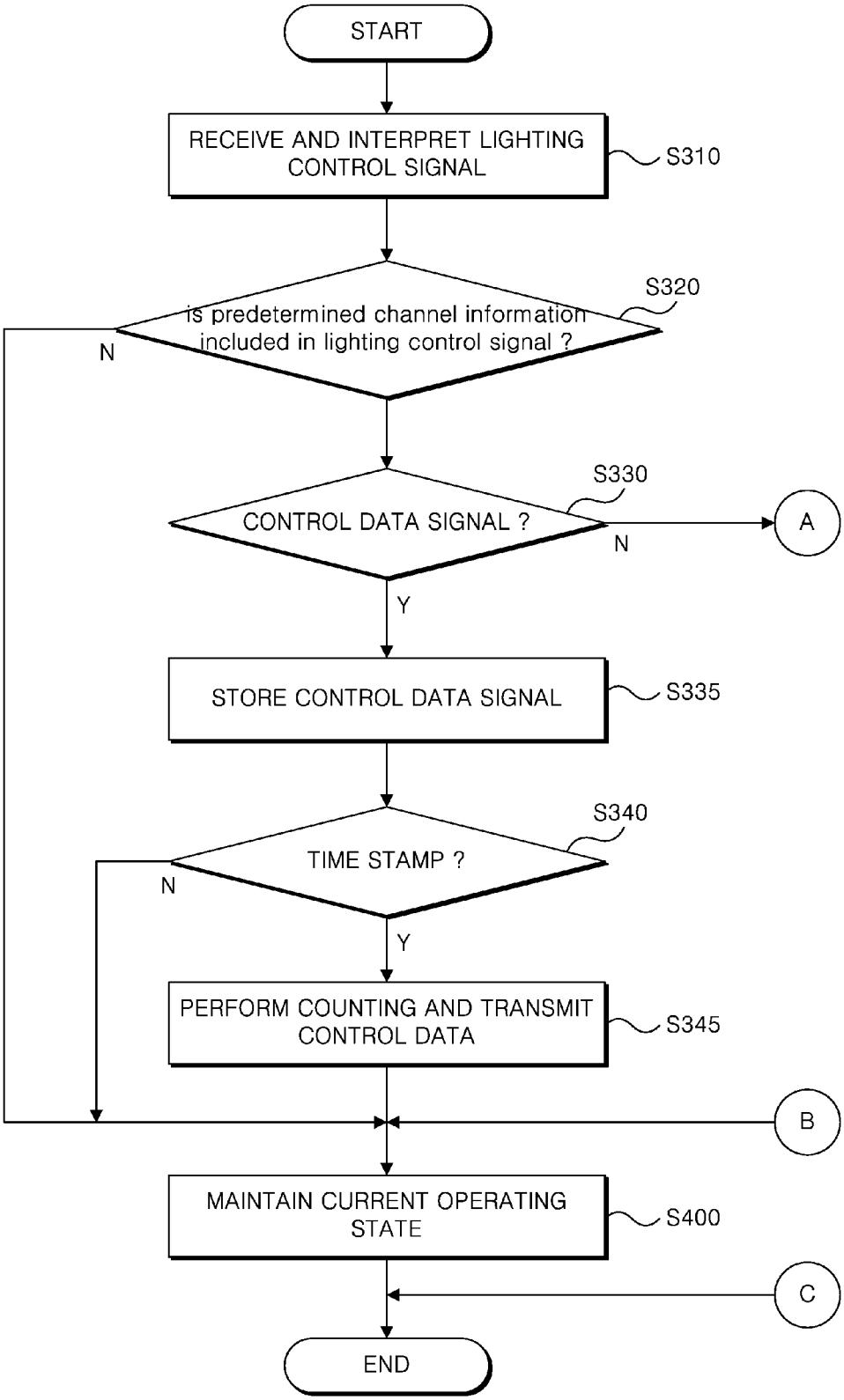
FIGS. 15 and 16 are illustrating a lighting control method of a converter, according to an embodiment.
Figure 16:
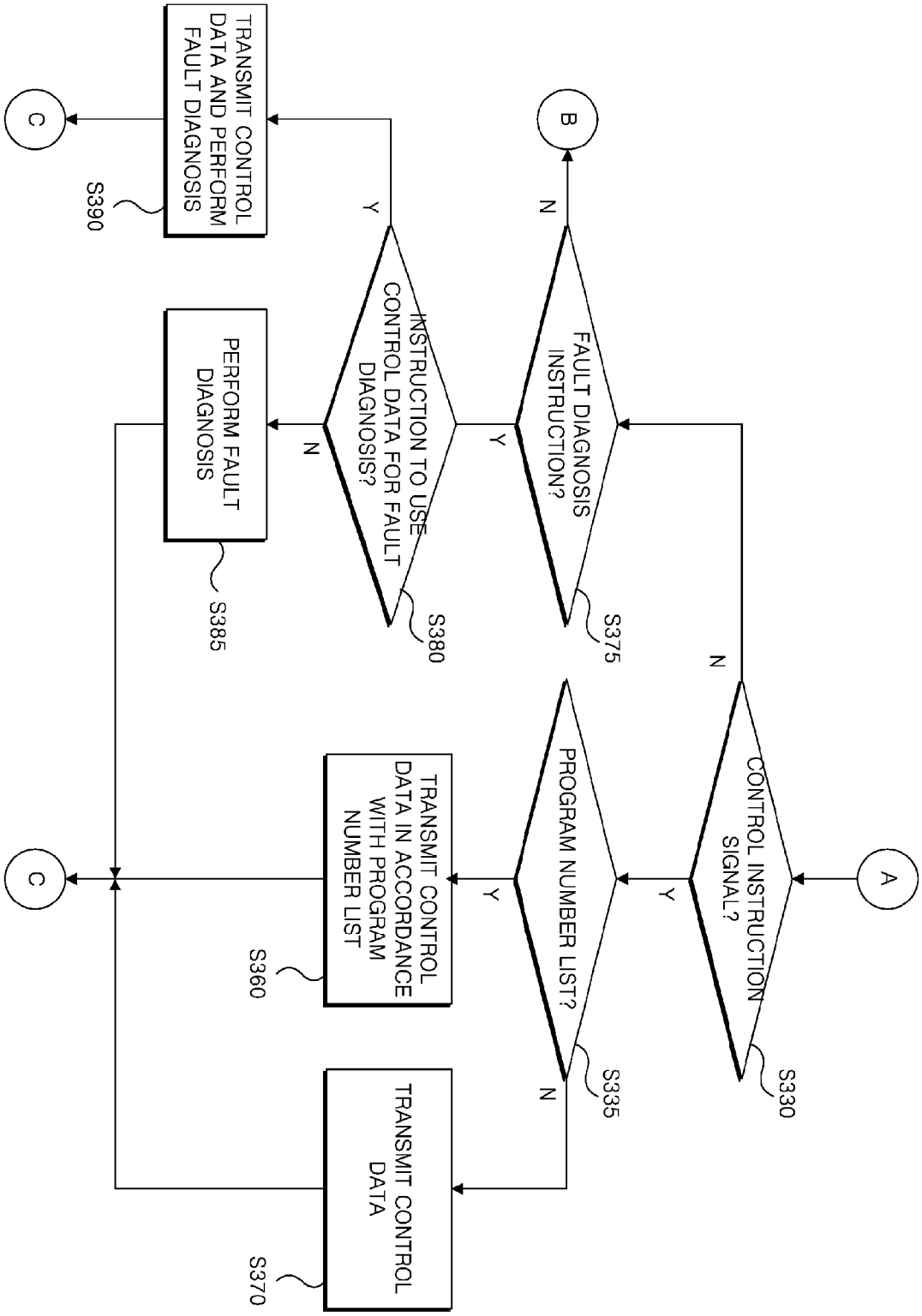

FIGS. 15 and 16 are flowcharts illustrating a lighting control method of a converter, according to an embodiment.

Referring to FIGS. 15 and 16, the converter 100 may receive a lighting control signal from the DMX central control device 10 or the RMD central control device 20, and may interpret the received lighting control signal (S310).

The converter 100 may determine whether the received control signal includes channel information of the converter 100 (S320).

In response to the received control signal not including the channel information of the converter 100, the converter 100 may control the driver 160 to maintain a previous operating state (S290). The converter 100 may continue to apply most-recently stored control data to the driver 160 or may control the driver 160 to continue to be switched on or off. S290 may be useful when there is the need to maintain the operating state of the LED module 170 or when there is no need to transmit a lighting signal often (for example, when the LED module 170 is used for an indoor lighting), and may be convenient in terms of energy efficiency and communication line (or bandwidth efficiency).

In response to the received control signal including the channel information of the converter 100, the converter 100 may determine whether the received control signal is a control data signal (S330).

In response to the received lighting control signal being a control data signal, the converter 100 may store the control data signal (S335). The converter 100 may determine whether the received lighting control signal is based on the DMX protocol or the RDM protocol, and may also determine whether the driver 160 is based on the DMX protocol or the RDM protocol. In response to the communication protocol of the received lighting control signal being different from the communication protocol of the driver 160, the converter 100 may convert the received lighting control signal to the communication protocol of the driver 160 (S335).

The converter 100 may determine whether the control data signal includes a time stamp (S340).

In response to the control data signal not including a time stamp, the converter 100 may stand by while maintaining the operating state of the driver 160 (S400).

In response to the control data signal including a time stamp, the converter 100 may transmit a control data code corresponding to the time stamp to the driver 160 (S345), and the lighting control method proceeds to S400.

In response to the received lighting control signal not being a control data signal, the converter 100 may determine whether the received lighting control signal is a control instruction signal (S350).

In response to the received lighting control signal being a control instruction signal, the converter 100 may determine whether the control instruction signal includes a program number list code (S355).

In response to the control instruction signal not including a program number list code, the converter 100 may transmit a most recently-stored control data code to the driver 160 (S370), and the lighting control method proceeds to S400.

In response to the control instruction signal including a program number list code, the converter 100 may transmit control data relating to one or more program numbers included in the program number list code to the driver 160 in the order of the program numbers (S360), and the lighting control method proceeds to S400.

In response to the received lighting control signal not being a control instruction signal, the converter 100 may determine whether the received lighting control signal includes a fault diagnosis instruction (S375). In response to the received lighting control signal not including a fault diagnosis instruction, the lighting control method proceeds to S400.

In response to the received lighting control signal including a fault diagnosis instruction, the converter 100 may determine whether the fault diagnosis instruction includes an instruction to use control data for fault diagnosis (S380).

In response to the fault diagnosis instruction including an instruction to use the control data for fault diagnosis, the converter 100 may transmit the control data for fault diagnosis to the driver 160, and may thus allow the driver 160 to perform fault diagnosis on the LED module 170 based on the corresponding control data (S390). More specifically, the converter 100 may detect any fault or failure in the LED module 170 by using one or more signals received from the measurement unit 120. In response to at least one of the LED groups of the LED module 170 being detected as being faulty, the converter 100 may notify the DMX central control device 10 or the RMD central control device 20 of the abnormal LED group(s) and may transmit identification information of the abnormal LED group(s), and the lighting control method ends.

In response to the fault diagnosis instruction not including an instruction to use the control data for fault diagnosis, the converter 100 may detect one or more faulty LED modules (S385) by combining the signals received from the measurement unit 120, and the lighting control method proceeds to S400.

The processes, functions, methods, and/or software described herein may be recorded, stored, or fixed in one or more computer-readable storage media that includes program instructions to be implemented by a computer to cause a processor to execute or perform the program instructions. The media may also include, alone or in combination with the program instructions, data files, data structures, and the like. The media and program instructions may be those specially designed and constructed, or they may be of the kind well-known and available to those having skill in the computer software arts. Examples of computer-readable storage media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light-emitting diode (LED) lighting control system, comprising:

a central control device configured to transmit a lighting control signal, which includes a control data signal for being used in controlling one or more LED modules and a control instruction signal for controlling the LED modules in accordance with the control data signal, to a plurality of channels, the control instruction signal being based on one of a unidirectional communication protocol and a bidirectional communication protocol;

a converter configured to be connected to one of the channels and determine whether the lighting control signal is based on the unidirectional communication protocol or the bidirectional communication protocol in response to the lighting control signal including channel information of the converter; and a driver configured to be connected to the converter and control the operation of a plurality of LED modules in accordance with a control data signal transmitted by the converter, wherein the converter is further configured to determine whether the driver is based on the unidirectional communication protocol or the bidirectional communication protocol and convert the communication protocol of the lighting control signal in response to the communication protocol of the driver being different from the communication protocol of the lighting control signal, wherein the plurality of LED modules are controlled by a current, the LED lighting control system further comprises a current-to-voltage converter configured to convert a current applied to a first LED module, which is one of the plurality of LED modules, into a voltage and a plurality of comparators configured to compare the voltage with a plurality of reference voltages, which are set in advance, and generate a plurality of digital values based on the results of the comparison, wherein the plurality of comparators are further configured to include a first comparator generating a first digital value by comparing the voltage with a first reference voltage, which is a voltage for driving one of the plurality of LED modules and a second comparator generating a second digital value by comparing the voltage with a second reference voltage, which is a voltage for driving two or more of the plurality of LED modules, and the converter is further configured to compare the plurality of digital values with control data included in the control data signal and detect any faulty LED modules from among the plurality of LED modules.

2. The LED lighting control system of claim 1, wherein the converter is further configured to in response to the lighting control signal being a control data signal, store control data included in the control data signal and to in response to the lighting control signal being a control instruction signal, execute an instruction included in the control instruction signal.

3. The LED lighting control system of claim 2, wherein the converter is further configured to in response to the control data signal including a time stamp, transmit the control data included in the control data signal to the driver based on time information extracted from the time stamp.

4. The LED lighting control system of claim 2, wherein the converter is further configured to in response to the control instruction signal including a synchronization instruction, transmit most recently-stored control data to the driver.

5. The LED lighting control system of claim 2, wherein the control data signal includes data code information and the converter is further configured to store the data code information in connection with the control data and to in response to the control instruction signal including a data code list, sequentially transmit at least one control data corresponding to one or more data code included in the data code list to the driver.

6. The LED lighting control system of claim 2, wherein the converter is further configured to in response to the control instruction signal including a "maintain" instruction, control the driver to maintain a recent operating state of the driver.

7. The LED lighting control system of claim 1, wherein the converter is further configured to transmit control data to the driver and control the driver to maintain a recent operating state of the driver.

8. The LED lighting control system of claim 1, wherein the converter is further configured to transmit an acknowledgement request signal to the driver and determine that the driver is based on the bidirectional communication protocol in response to receipt of an acknowledgement signal from the driver.

9. The LED lighting control system of claim 1, wherein the plurality of LED modules are controlled by a current, the LED lighting control system further comprises a current-to-voltage converter configured to convert a current applied to a first LED module, which is one of the plurality of LED modules, into a voltage and a comparator configured to compare the voltage with a reference voltage, which is set in advance, and generate a digital value based on the results of the comparison, and the converter is further configured to in response to a control signal for turning on or off the first LED module being different from the digital value, transmit identification information of the first LED module and fault information to the central control device.

10. The LED lighting control system of claim 1, wherein the bidirectional communication protocol is the Digital Multiplex (DMX)-512A protocol or the Remote Device Management (RDM) protocol and the unidirectional communication protocol is DMX-512 protocol.

11. The LED lighting control system of claim 3, wherein the converter is further configured to transmit control data to the driver and control the driver to maintain a recent operating state of the driver.

12. The LED lighting control system of claim 4, wherein the converter is further configured to transmit control data to the driver and control the driver to maintain a recent operating state of the driver.

13. The LED lighting control system of claim 5, wherein the converter is further configured to transmit control data to the driver and control the driver to maintain a recent operating state of the driver.

14. The LED lighting control system of claim 1, wherein the converter is further configured to transmit control data for fault diagnosis to the driver, wherein the control data for fault diagnosis sets the plurality of LED modules to emit light at different times and the driver performs the fault diagnosis on the plurality of LED modules in response to the control data for fault diagnosis.

* * * * *